US006443595B1

(12) United States Patent
Tseng

(10) Patent No.: US 6,443,595 B1
(45) Date of Patent: Sep. 3, 2002

(54) DECORATIVE LAMP

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/800,410

(22) Filed: Mar. 6, 2001

(51) Int. Cl.[7] ..... F21V 21/30; F21S 4/00
(52) U.S. Cl. ..... 362/250; 362/252; 362/806
(58) Field of Search ..... 362/227, 234, 362/249, 250, 252, 396, 806

(56) References Cited

U.S. PATENT DOCUMENTS 1,702,028 A * 2/1929 Blanchard ..... 362/249
4,462,065 A * 7/1984 Rhodes ..... 362/250
4,866,581 A * 9/1989 Targetti ..... 362/249
5,645,343 A * 7/1997 Rinehimer ..... 362/252
5,876,111 A * 3/1999 Wu ..... 362/250
5,993,025 A * 11/1999 Huang ..... 362/249
6,056,418 A * 5/2000 Hsu ..... 362/249
6,183,110 B1 * 2/2001 Chang ..... 362/249
6,196,700 B1 * 3/2001 Lai ..... 362/249

* cited by examiner

*Primary Examiner*—Alan Cariaso
(74) *Attorney, Agent, or Firm*—Merchant & Gould P.C.

(57) ABSTRACT

A decorative lamp has two sector frames each with a plurality of radial and circular bars, a plurality of bulb-holders assembled on the bars, and an electrical wire electrically connected with the bulb-holders.

13 Claims, 10 Drawing Sheets

DECORATIVE LAMP

BACKGROUND OF THE INVENTION

1. Field of the Invention

The present invention is related to a decorative lamp, and more particularly to a decorative lamp which is convenient to be installed and stored.

2. Description of Related Art

At festivals and other special occasions, decorative lamps are widely used ornaments. Conventional decorative lamps, which have unspecific appearances, generally cover or are twisted on something which needs to be decorated. Hence, it is very inconvenient for a user to set up these decorative lamps. Moreover, it is also difficult to store the decorative lamps.

Therefore, the invention provides a decorative lamp to mitigate and/or obviate the aforementioned problems.

SUMMARY OF THE INVENTION

The main objective of the invention is to provide a decorative lamp which is easy to be set up.

Another objective of the invention is to provide a decorative lamp which is convenient to be stored.

Other objects, advantages and novel features of the invention will become more apparent from the following detailed description when taken in conjunction with the accompanying drawings.

DETAILED DESCRIPTION OF THE PREFERRED EMBODIMENT

Figure 1:
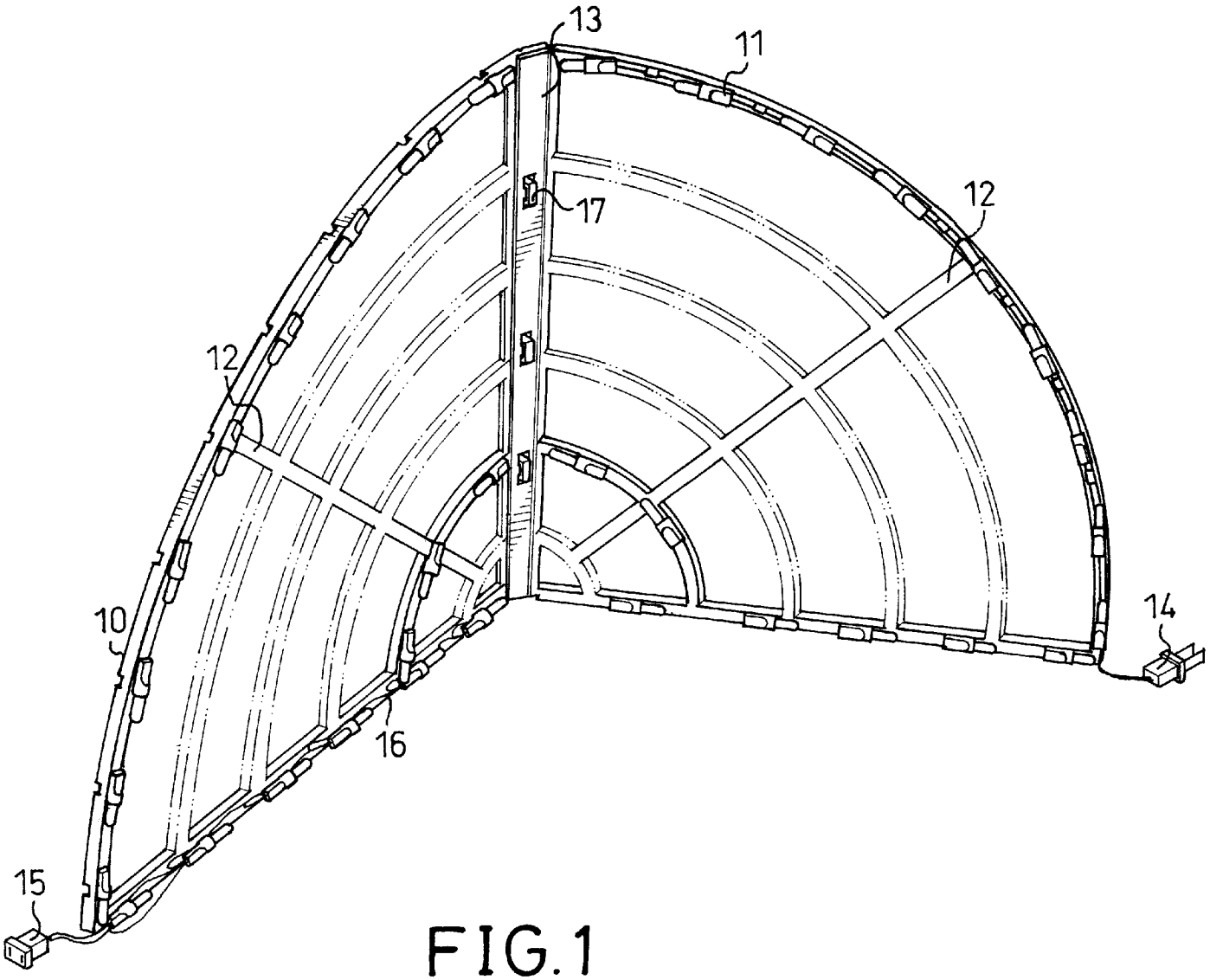
FIG. 1 is a perspective view of a decorative lamp in accordance with the invention.

Referring to FIG. 1, a decorative lamp in accordance with the present invention is composed of two sector frames (10), each shaped as a quarter of a circle, assembled together to form a semi-circle. The frames (10) each are constructed by a plurality of radial and circular bars (12), and a plurality of bulb-holders (11) installed on the bars (12). Each frame (10) has an upright side with a brim (13) formed therealong, and the brims (13) are designated as a first and a second.

Figure 2:
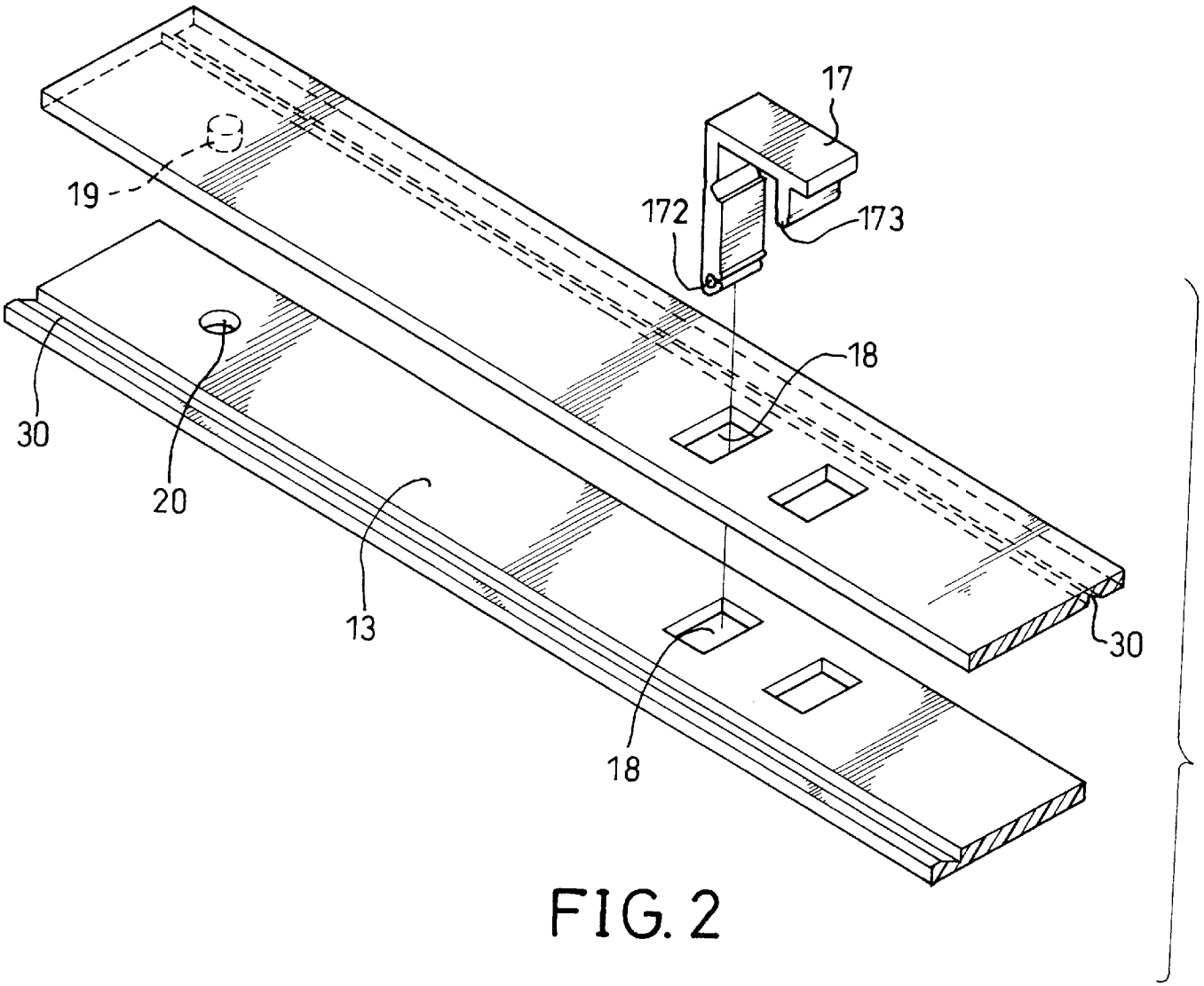
FIG. 2 is an exploded perspective view of brims of the decorative lamp in accordance with the invention.

Referring to FIGS. 1 and 2, the brims (13) each have a plurality of openings (18) in pairs defined therethrough. A pin (19) and an aperture (20) are respectively formed on the first brim (13) and the second brim (13), and in alignment with each other. A plurality of fastening members (17) is respectively inserted through the openings (18) and secured therein to assemble the sector frames (10) together. At the same time, the pin (19) is received in the aperture (20). Furthermore, the brims (13) each have a groove (30) longitudinally defined therein. Thus, the frames (10) are able to be folded towards each other along the grooves (30).

The fastening members (17) each are substantially formed as an inverted "U" with a long leg (not numbered) with a pivot notch defined therein, a short leg (173) and a central portion (not numbered), wherein the long leg has a C-like channel (172) defined at a free end thereof to engage with the short leg (173) when bent inwards about the pivot notch. Each long leg is configured to be extendable through mated first openings (18) of the combined brims (13) and then deformed about the pivot notch, and the short leg (173) is simultaneously fed through mated second openings (18) of the combined brims (13) to engage with the C-like channel (172). Thus, the frames (10) are securely assembled together by the fastening members (17).

Figure 3:
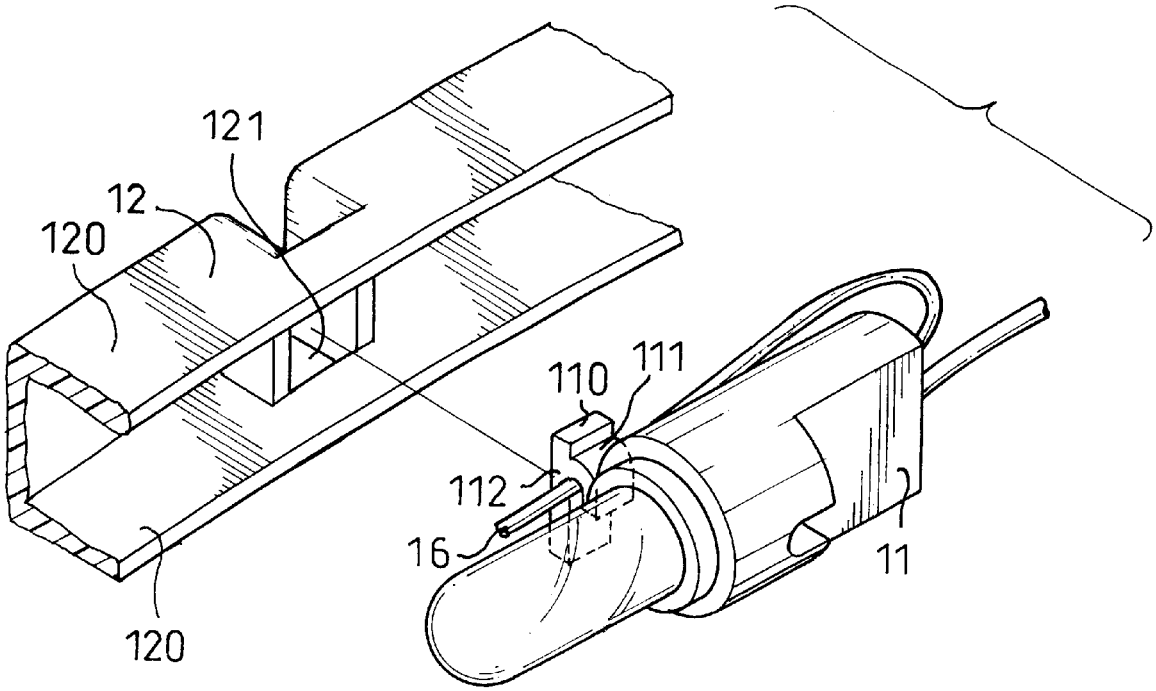
FIG. 3 is an exploded view showing a bulb-holder and a bar of the decorative lamp.
Figure 5:
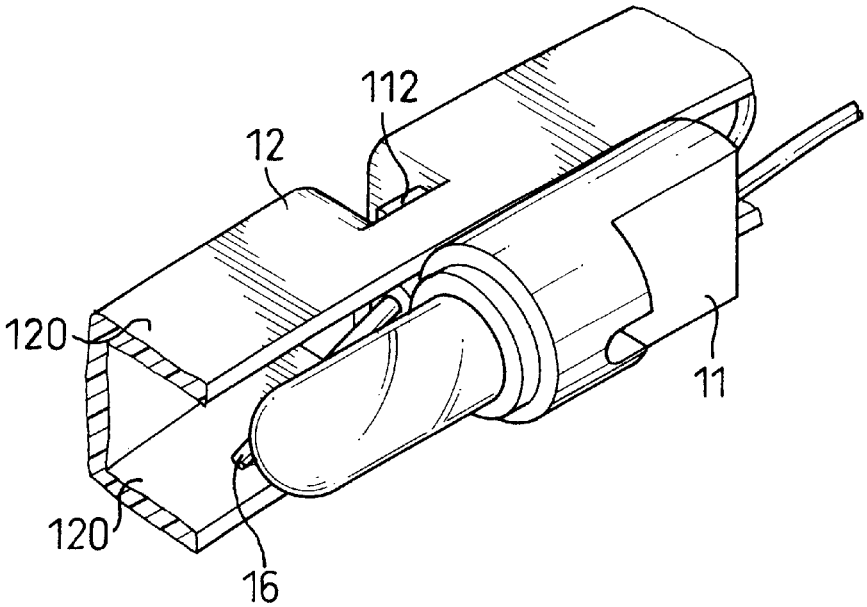
FIG. 5 is a perspective view showing the bulb-holder being assembled on the bar in FIG. 3.
Figure 4:
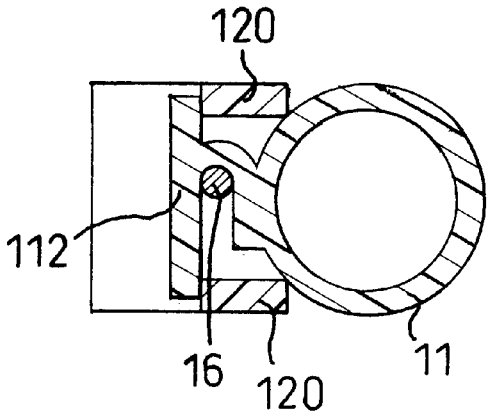
FIG. 4 is a sectional view showing the bulb-holder and the bar in FIG. 3.

Referring to FIGS. 3–5, the bars (12) each have a C-like section with two parallel lateral parts (120) and an upright part (not numbered) extending between the lateral parts (120). A plurality of notches (121) is defined in each of the bars (12) and evenly spaced apart. The bulb-holders (11) each have a fastener (110) formed at a side thereof faced to the notches (121). In this embodiment, the fastener (110) is shaped as an "r" with an arcuate portion (111) and a tab (112). An electrical wire (16) is clamped through these arcuate portions (111), and the tabs (112) are respectively fastened in the notches (121) to assemble the bulb-holders (11) on the bars (12). Specially referring to FIG. 4, the length of the tab (112) is slightly larger than the distance between the lateral parts (120), so that the bulb-holder (11) is unable to be disengaged from the notch (121) without an external force.

Figure 6:
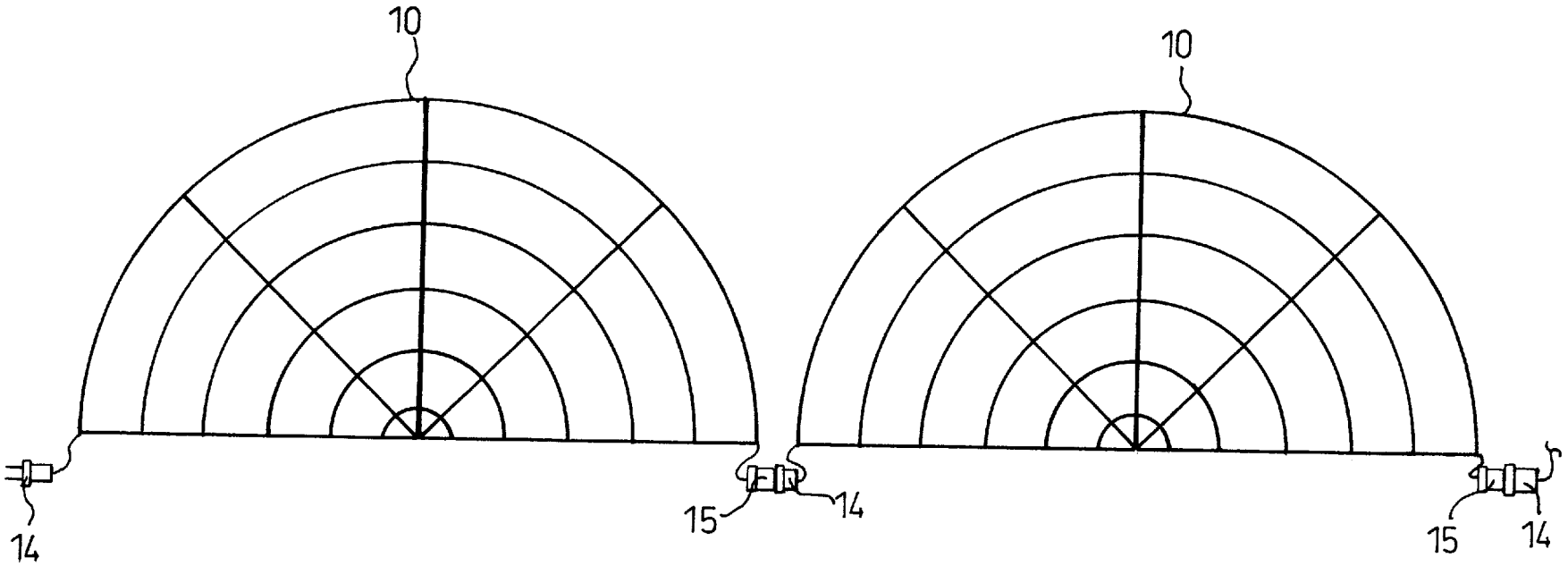
FIG. 6 is a schematic view showing a plurality of decorative lamps of the invention being connected in series.

Moreover, referring back FIG. 1, the first frame (10) and the second frame (10) have a plug (14) and a socket (15) provided at a bottom thereof and electrically connected with the wire (16), respectively. The plug (14) can be connected with an electrical source, or inserted within a socket (15) of another decorative lamp. Thus, according to the present invention, a plurality of decorative lamps can be connected in series, as shown in FIG. 6.

Figure 7:
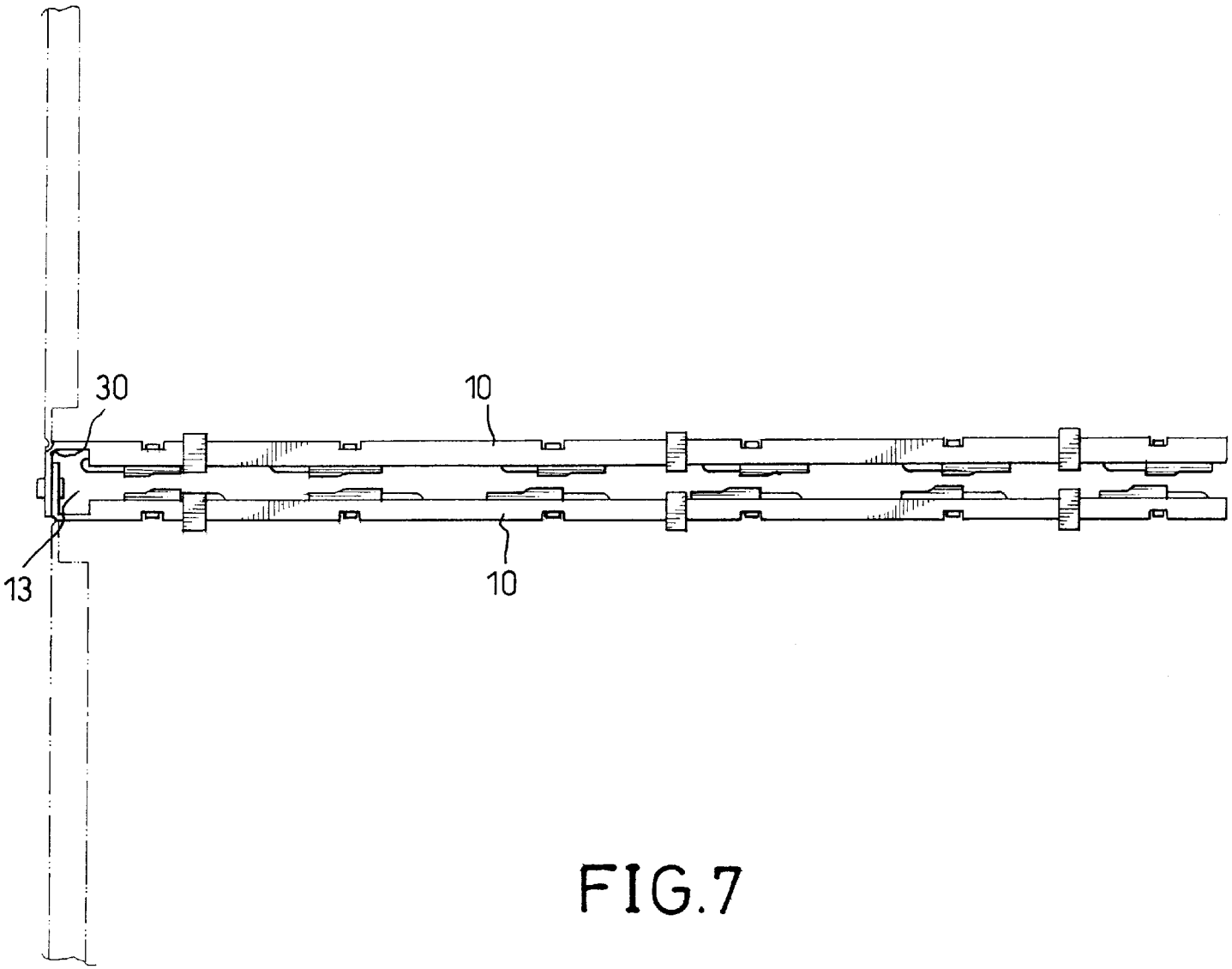
FIG. 7 is a schematic view showing the decorative lamp folded for storage.

Referring to FIG. 7, the decorative lamp can be folded along the grooves (30) on the brims (13) for being stored.

Figure 8:
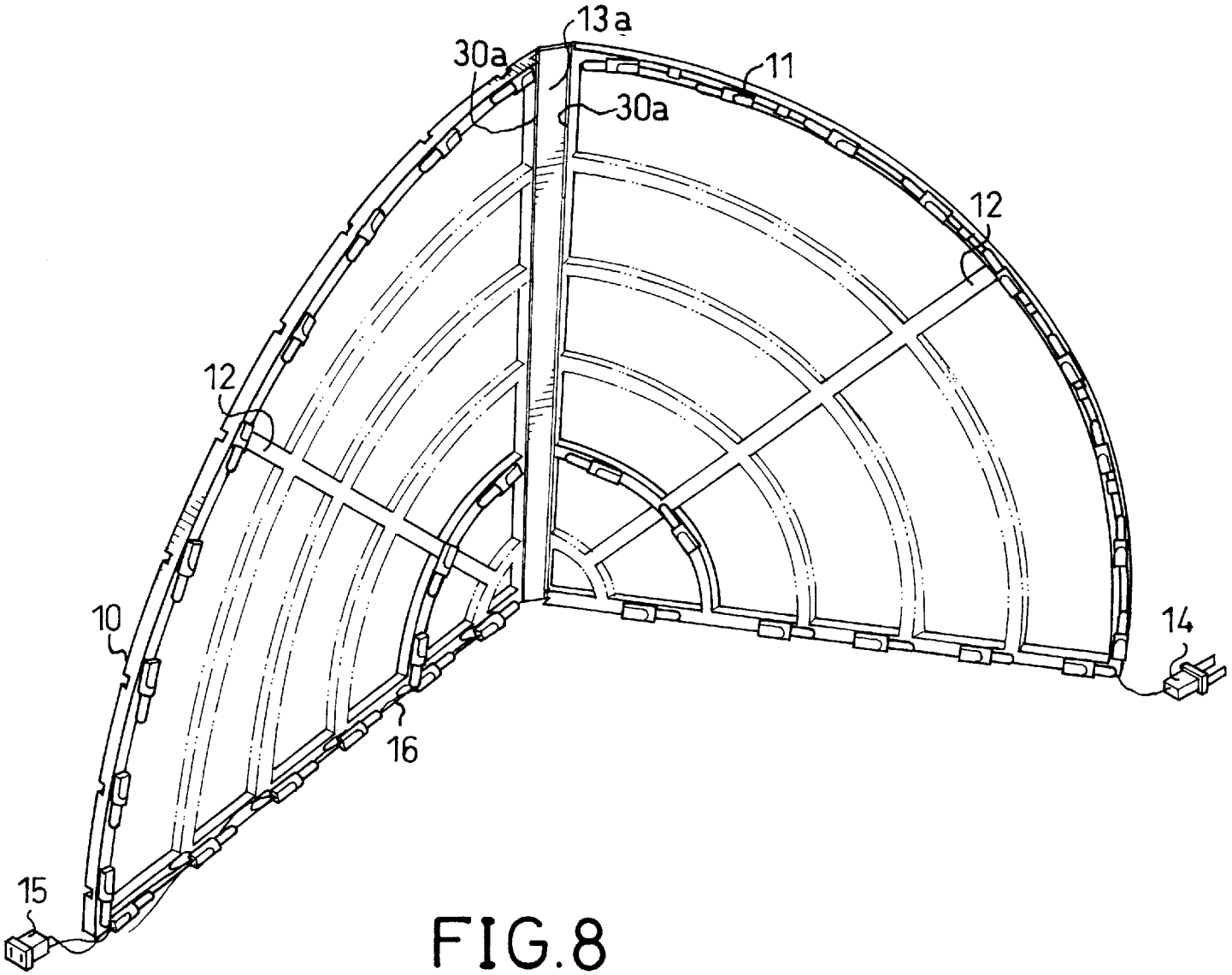
FIG. 8 is a perspective view of a second embodiment of the decorative lamp in accordance with the invention.

In a second embodiment of the invention as shown in FIG. 8, the decorative lamp only has a single integral brim **(13*a*) formed between the frames (10), and the single brim (13*a*) includes two grooves (30*a*)**.

Figure 10:
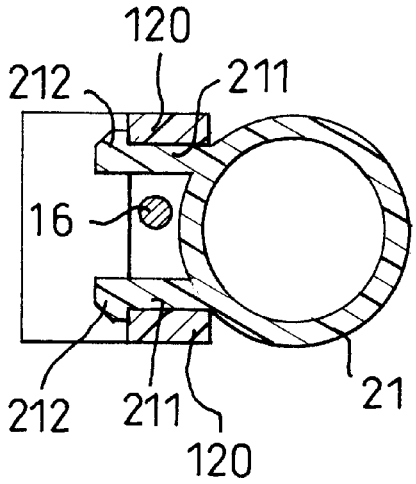
FIG. 10 is a sectional view of the bulb-holder and the bar in FIG. 9.
Figure 9:
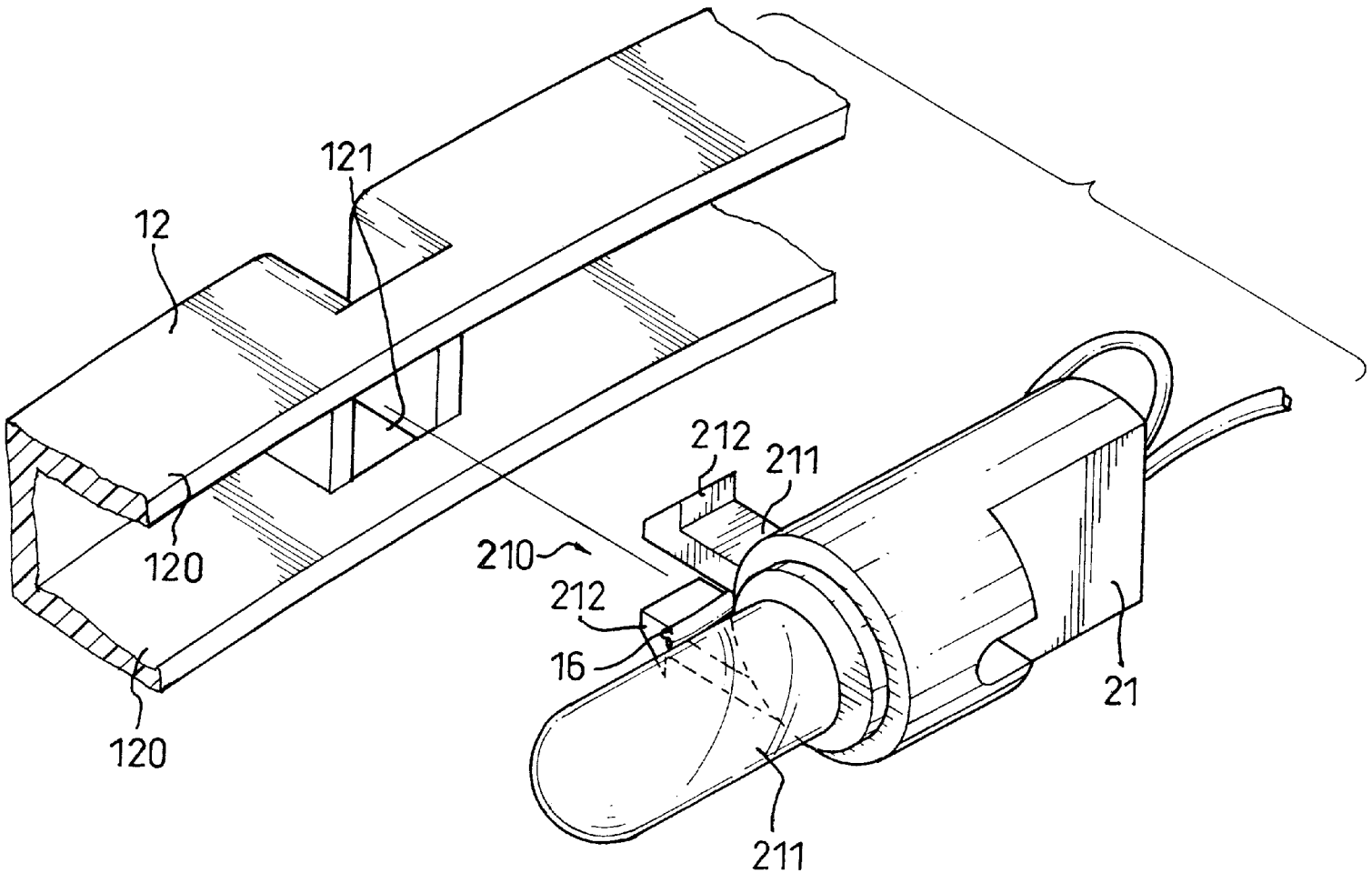
FIG. 9 is an exploded perspective showing a bulb-holder and a bar in a third embodiment in accordance with the invention.

Referring to FIGS. 9 and 10, in a third embodiment of the invention, second bulb-holders (21) each have two tongues (210) extending outwards and fastened in the respective slot (121). The tongues (210) each have a finger (211) and a barb (212). The wire (16) extends through between the fingers (211), and the barbs (212) are attached on the lateral parts (120) to prevent the bulb-holders (21) disengaging from the bars (12).

Figure 12:
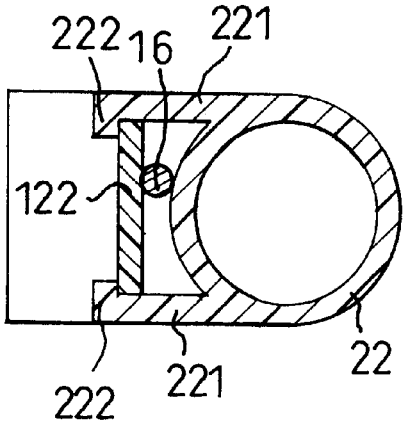
FIG. 12 is a sectional view of the bulb-holder and the bar in FIG. 11.
Figure 11:
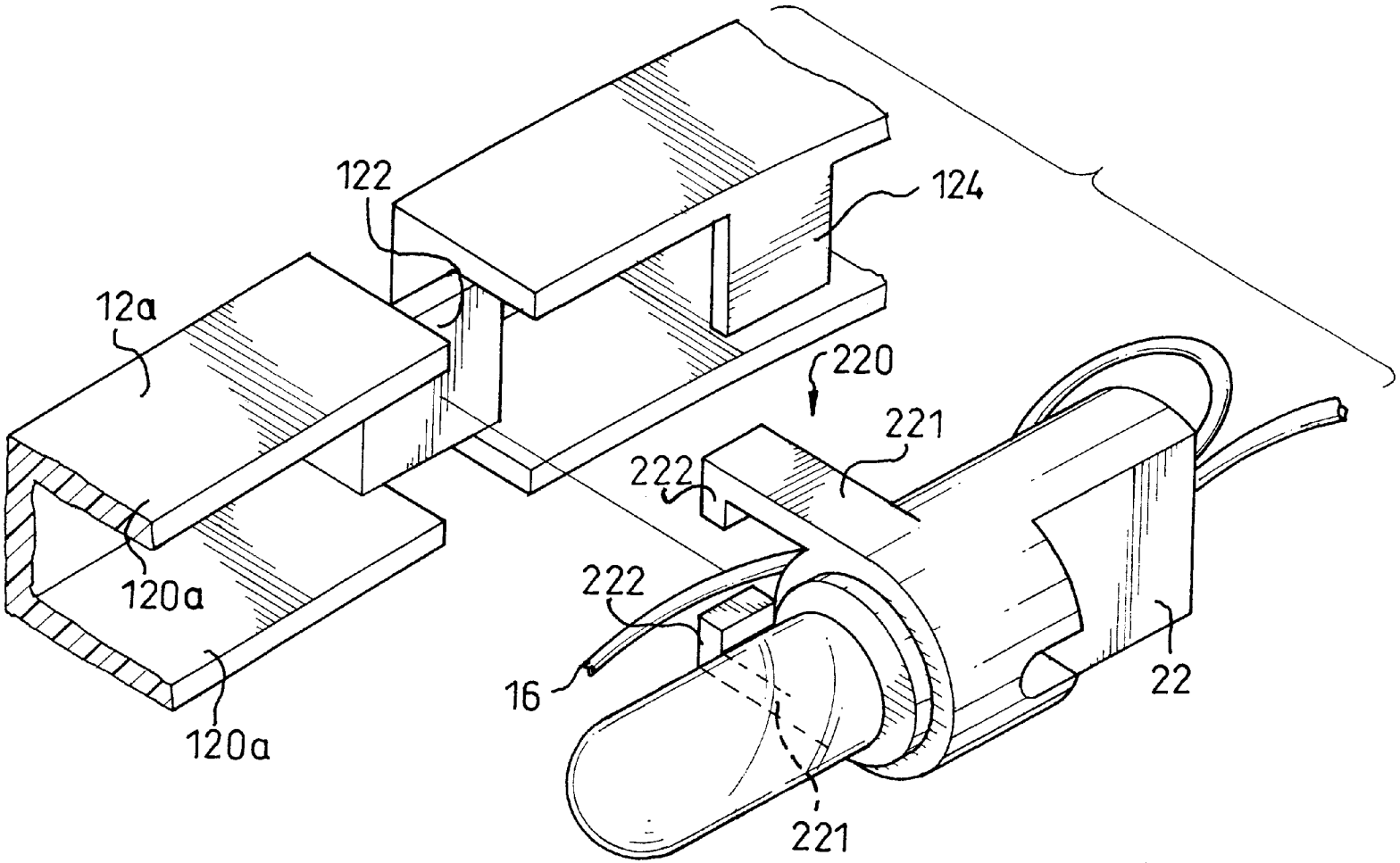
FIG. 11 is an exploded perspective showing a bulb-holder and a bar in a fourth embodiment in accordance with the invention.

Referring to FIGS. 11 and 12, in a fourth embodiment of the invention, the bars (12*a*) each have a plurality of plates (122) formed between the lateral parts (120) to replace the notches (121) in the first embodiment. A plurality of first retainers (124) is formed at upper edges of the lateral parts (120*a*) and extends downwards for corresponding to the plates (122) respectively. Third bulb-holders (22) each have two L-shaped attaching members (220), which are composed of an arm (221) and a hook (222), extending outwards. The hooks (222) of the attaching members (220) are attached to the respective attaching plate (122) to assemble the bulb-holders (22) on the bars (12). At the same time, the wire (16) can be positioned in the first retainers (124).

Figure 14:
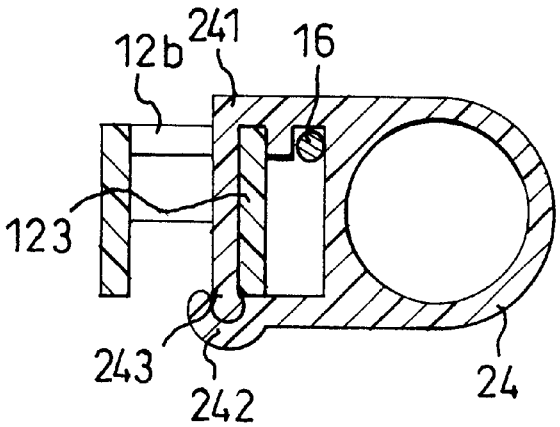
FIG. 14 is a sectional view of the bulb-holder and the bar in FIG. 13.
Figure 13:
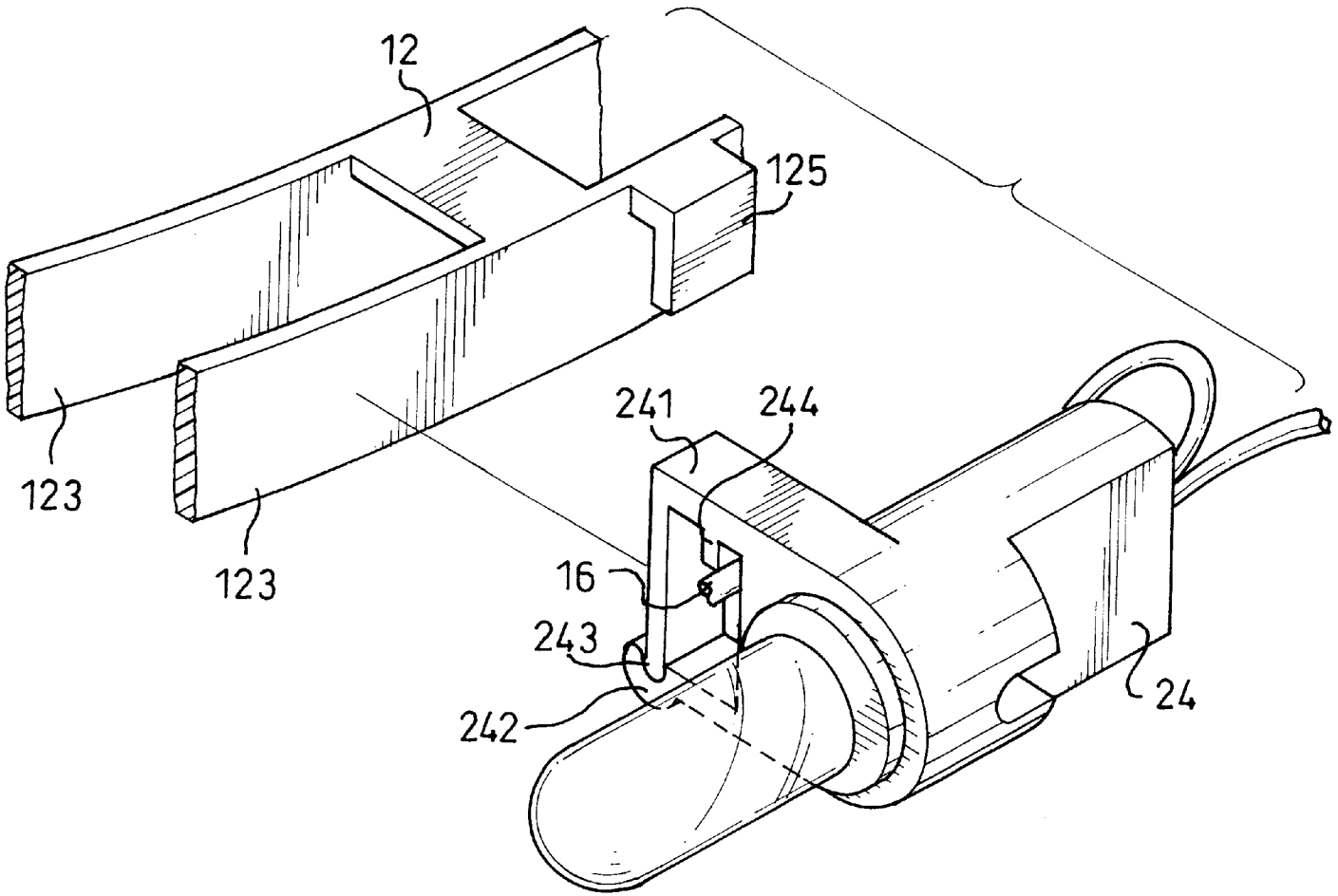
FIG. 13 is an exploded perspective showing a bulb-holder and a bar in a fifth embodiment in accordance with the invention.

FIGS. 13 and 14 show a fifth embodiment of the invention. In this embodiment, the bars (12*b*) each are composed of two upright plates (123) and a plurality of lateral plates (not numbered) formed between the upright plates (123) and evenly spaced apart. A plurality of second retainers (125) is formed on one of the upright plates (123) and corresponds to the lateral plates respectively. Fourth bulb-holders (24) each have a clamp (241) for assembling the bulb-holders (24) on the bars (12*b*). The clamps (241) each have a second C-like channel (242) and a bending portion (243). A rib (244) is formed at an upper wall of the clamp (241). The wire (16) is positioned in the second retainers (125) and, between the ribs (244) and side walls of the clamp (241) adjacent the bulb-holders (24). The upright plate (123) with the second retainers (125) is positioned between the rib (244) and side walls of the clamp (241) away from the bulb-holders (24). The bending portions (243) are respectively engaged in the second C-like channels (242) to secure the bulb-holders (24) on the bar (12*b*).

From the above description, it is noted that the invention has the following advantages:

1. It is very convenient for a user to set up the decorative lamp;
2. The decorative lamp can be folded for storing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative lamp comprising:

two sector frames (10) assembled together to form a semi-circle and each having a plurality of radial bars and a plurality of circular bars (12) spaced along the radial bars, and a brim formed at an upright side thereof, each of the brims having a groove longitudinally defined therealong, and each of the brims being assembled by a plurality of fastening members;

a plurality of bulb-holders (11) assembled on the radial and circular bars (12); and an electrical wire (16) electrically connected with the bulb-holders (11).

2. The decorative lamp as claimed in claim 1 further comprising an integral brim (13*a*) integrated between the frames (10*a*), and two grooves (30*a*) longitudinally defined in the brim (13) to enable the frames (10) to fold relative to each other.

3. The decorative lamp as claimed in claim 1 wherein the brims (13) each have a plurality of paired openings (18) defined therein; and the fastening members (17) each are formed as an inverted "U" with a long leg, a short leg and a central portion, wherein the long leg is able to be bent and has a first C-like channel (172) defined at a free end thereof;

whereby, when the long legs and the short legs are respectively inserted through the openings (18), the long legs are bent inwards to engage the short legs in the first C-like channels.

4. The decorative lamp as claimed in claim 1, wherein a first of the brims (13) has a pin (19) formed thereon, and the second brim (13) has an aperture (30) defined therein for receiving the pin (19).

5. The decorative lamp as claimed in claim 1, wherein the bars (12) each have a C-shaped section with two lateral parts (120) and an upright part formed between the lateral parts (120), and a plurality of notches (121) defined in the bars (12).

6. The decorative lamp as claimed in claim 5 wherein the bulb-holders (11) each have a fastener (110), which is formed as an "r" with an arcuate portion (111) and a tab (112), to position in the respective notch (121).

7. The decorative lamp as claimed in claim 5, wherein the bulb-holders (21) each have two tongues (210) formed thereon and extending outwards to position in the respective notch (121), the tongues (210) each having a finger (211) and a barb (212) formed at a free end of the finger (211) to attach the lateral parts (120) for preventing the bulb-holders (21) from disengaging from the bar (12).

8. The decorative lamp as claimed in claim 1, wherein the bars (12) each have a C-shaped section with two lateral parts (120) and an upright part formed between the lateral parts (120), and a plurality of plates (122) formed in the bars (12).

9. The decorative lamp as claimed in claim 8, wherein the bulb-holders (22) each have two L-shaped attaching members (220) extending outwards to attach the respective plate (120), the L-shaped attaching members (220) each being composed of an arm (221) and a hook (222).

10. The decorative lamp as claimed in claim 3, wherein the bars (12) each are composed of two upright plates (123), and a plurality of lateral plates is formed between the upright plates (123).

11. The decorative lamp as claimed in claim 10 wherein the bulb-holders (24) each have a clamp (241) to be positioned on one of the upright plates (123), the clamps (241) each having a second C-like channel (242) and a bending portion (241), whereby, when the clamps (241) are mounted on the upright plate (123), the bending portions (241) are respectively engaged in the second C-like channels (242).

12. The decorative lamp as claimed in claim 11, wherein the clamps (241) each further comprise a rib (244) formed at an upper wall thereof.

13. The decorative lamp as claimed in claim 1, wherein the frames (10) have a plug (14) and a socket (15) provided thereon respectively and electrically connected with the bulb-holders (11).

* * * * *